United States Patent [19]

Clarkson

[11] 4,441,768

[45] Apr. 10, 1984

[54] OFFICE CABINET

[75] Inventor: Joseph Clarkson, Seacroft, England

[73] Assignee: Thatchcode Limited, Great Britain

[21] Appl. No.: 358,695

[22] Filed: Mar. 16, 1982

[51] Int. Cl.[3] ..... A47B 43/00; E06B 9/14

[52] U.S. Cl. ..... 312/257 SM; 312/111; 312/259; 312/297

[58] Field of Search ..... 312/257 A, 257 SM, 257 SK, 312/259, 297

[56] References Cited

U.S. PATENT DOCUMENTS

| | | | |
|---|---|---|---|
| 813,679 | 2/1906 | Vetter | 312/297 |
| 2,206,767 | 7/1940 | Derman | 312/297 |
| 2,739,730 | 3/1956 | Jonas | 312/297 |
| 3,472,571 | 10/1969 | Himelreich | 312/259 |
| 3,697,363 | 10/1972 | Martinez | 312/257 A |
| 3,712,697 | 1/1973 | Kelley et al. | 312/297 |
| 3,779,623 | 12/1973 | Motohashi | 312/257 A |
| 3,837,041 | 9/1974 | Modert et al. | 312/297 |
| 4,171,150 | 10/1979 | Soderlund | 312/111 |
| 4,173,379 | 11/1979 | van der Heiden et al. | 312/257 SM |
| 4,270,816 | 6/1981 | Erickson et al. | 312/297 |

FOREIGN PATENT DOCUMENTS

| | | | |
|---|---|---|---|
| 1150069 | 1/1958 | France | 312/257 SK |

*Primary Examiner*—Victor N. Sakran

*Attorney, Agent, or Firm*—Burns, Doane, Swecker & Mathis

[57] ABSTRACT

An office cabinet is provided with steel end panels made by press forming and shaped to mimic chipboard slab ends with rounded corners. The end members are hollow and provided on their inner faces with arrays of apertures for mounting shelves and other fittings within the cabinet.

9 Claims, 7 Drawing Figures

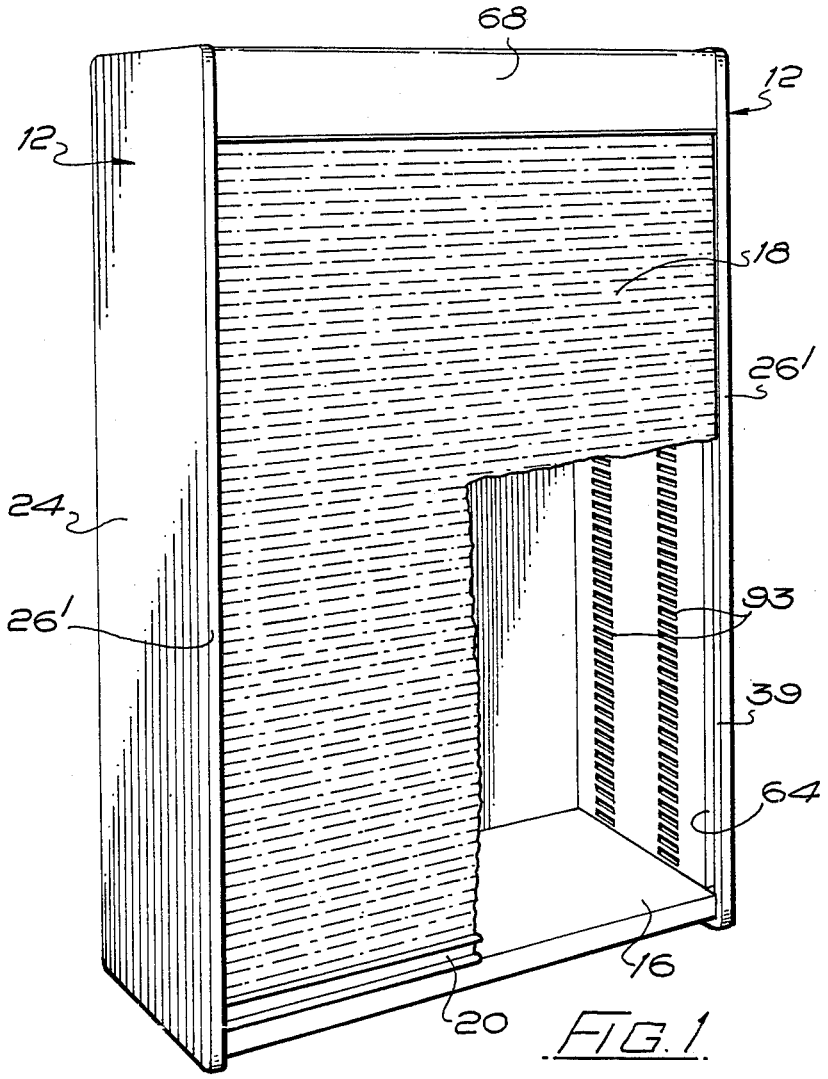
FIG. 1
FIG. 2
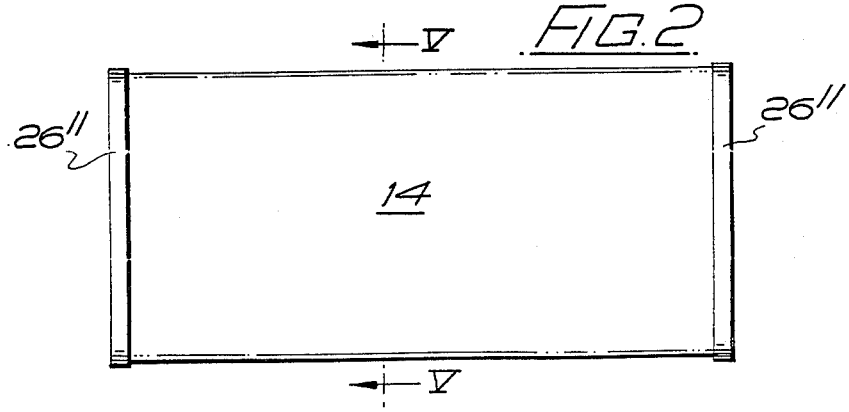

OFFICE CABINET

BACKGROUND OF THE INVENTION

Chipboard, a wood-based material, is frequently used in manufacturing office fittings and furniture. For this use the chipboard is provided with a decorative surface finish, for example wood vineer or plastic sheeting while separate edge lippings may be employed to cover the edges of the board. In particular, chipboard panels with rounded corners may be used to form the sides or ends of cupboards or desks and the edges of these panels may be deliberately left exposed giving a distinctive "slab-end" appearance. Board panels with rounded corners can be employed to give a distinctive design appearance.

Although chipboard is the only material used for slab-ends to fairly large office cabinets where a substantial load carrying capability is required, it is somewhat unsatisfactory in this application. With such cabinets, chipboard is liable to bow outwardly, it is difficult to provide satisfactory concealed fastenings into the chipboard, and the large panels required would add substantially to the weight of such cabinets. Office cabinets are nowadays often required to be able to receive internal fittings at a variety of positions. This cannot readily be achieved with a chipboard end panel, except by fitting a steel inner panel spaced inwardly from the inside face of a chipboard end panel and thereby increasing the bulk of the cabinet.

Steel has been used for cabinet ends, but it has then been customary for the cabinets to have right angled corners, and the slab end effect has not been sought.

SUMMARY OF THE INVENTION

The object of the present invention is to utilise end panels made from sheet metal to avoid or ameliorate the above mentioned disadvantages of chipboard end panels while forming the end panels in such a way as to mimic the appearance which can be achieved with chipboard. By means of the invention it becomes impossible to design an office cabinet so as to have continuity of styling with other office furniture and fittings which make extensive use of slab ends formed from chipboard panels with rounded corners.

In this invention an end member of a cabinet is formed from sheet metal which is shaped so as to provide a plane face which is generally rectangular but having rounded corners, while also providing edge faces around at least part of the periphery of the plane face which curve around the rounded corners so that the end member mimics the shape of a board with rounded corners. These edge faces should of course be substantially narrower than the plane face but substantially wider than the thickness of the metal sheet.

Preferably the end member is formed from a sheet metal blank having an area corresponding to the plane face, portions which will form the edge faces contiguous with this along the straight edges between the rounded corners, and continuations of the edge forming portions projecting beyond the limits of the straight edges, which form the curving portions of edge face which extend around the rounded corners.

It is then preferable that fixing flanges, parallel to the plane face, but spaced from it, extend inwardly from the edge faces.

A cabinet embodying this invention may be constructed as a set of parts suitable for shipment in KD (knocked-down) form, and subsequent assembly by riveting.

BRIEF DESCRIPTION OF THE DRAWINGS

FIG. 1 is a perspective view of a cabinet embodying this invention;

FIG. 2 is a top plan view of the cabinet;

DESCRIPTION OF PREFERRED EMBODIMENT

Figure 3:
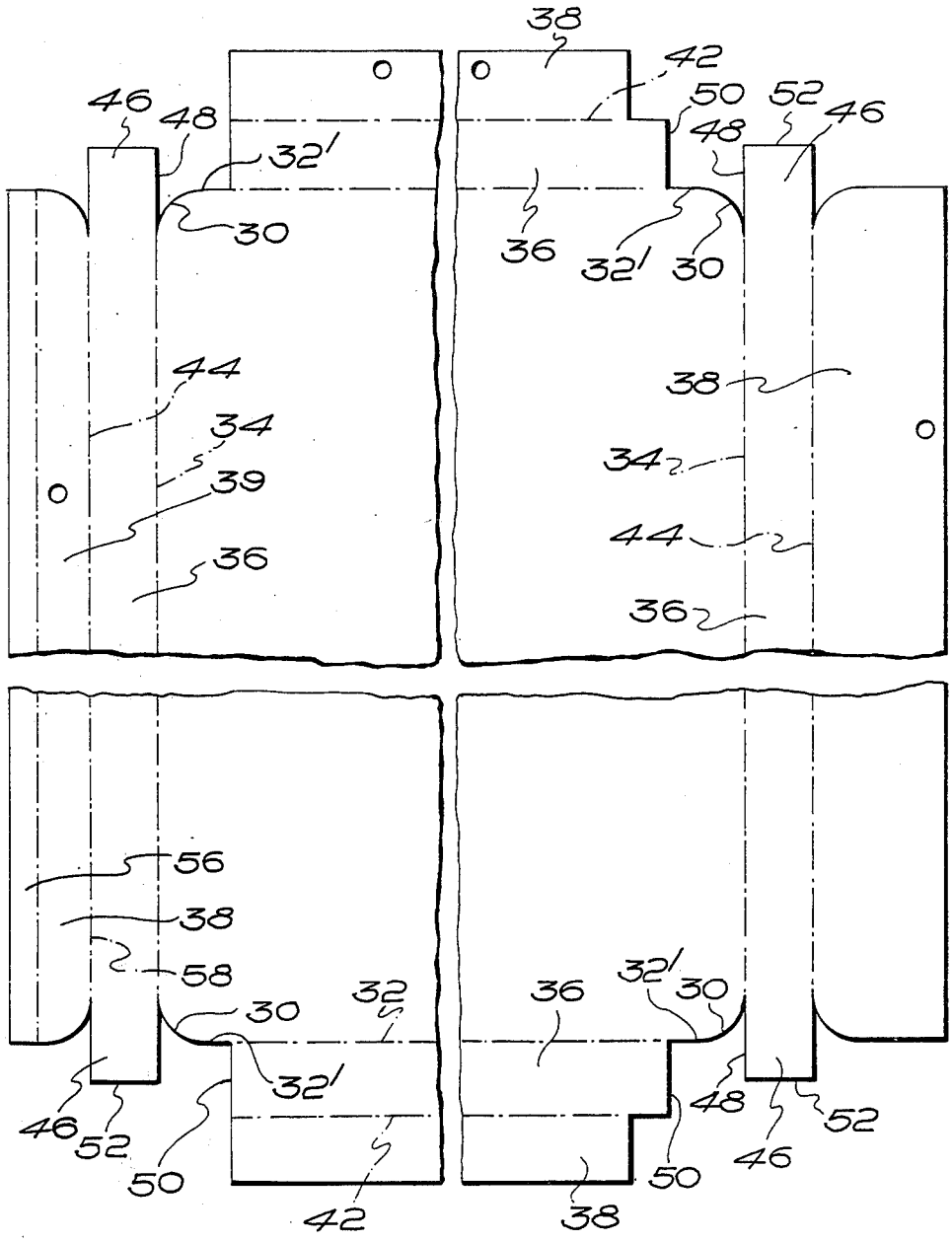
FIG. 3 shows the blank for the outer section of an end member.
Figure 4:
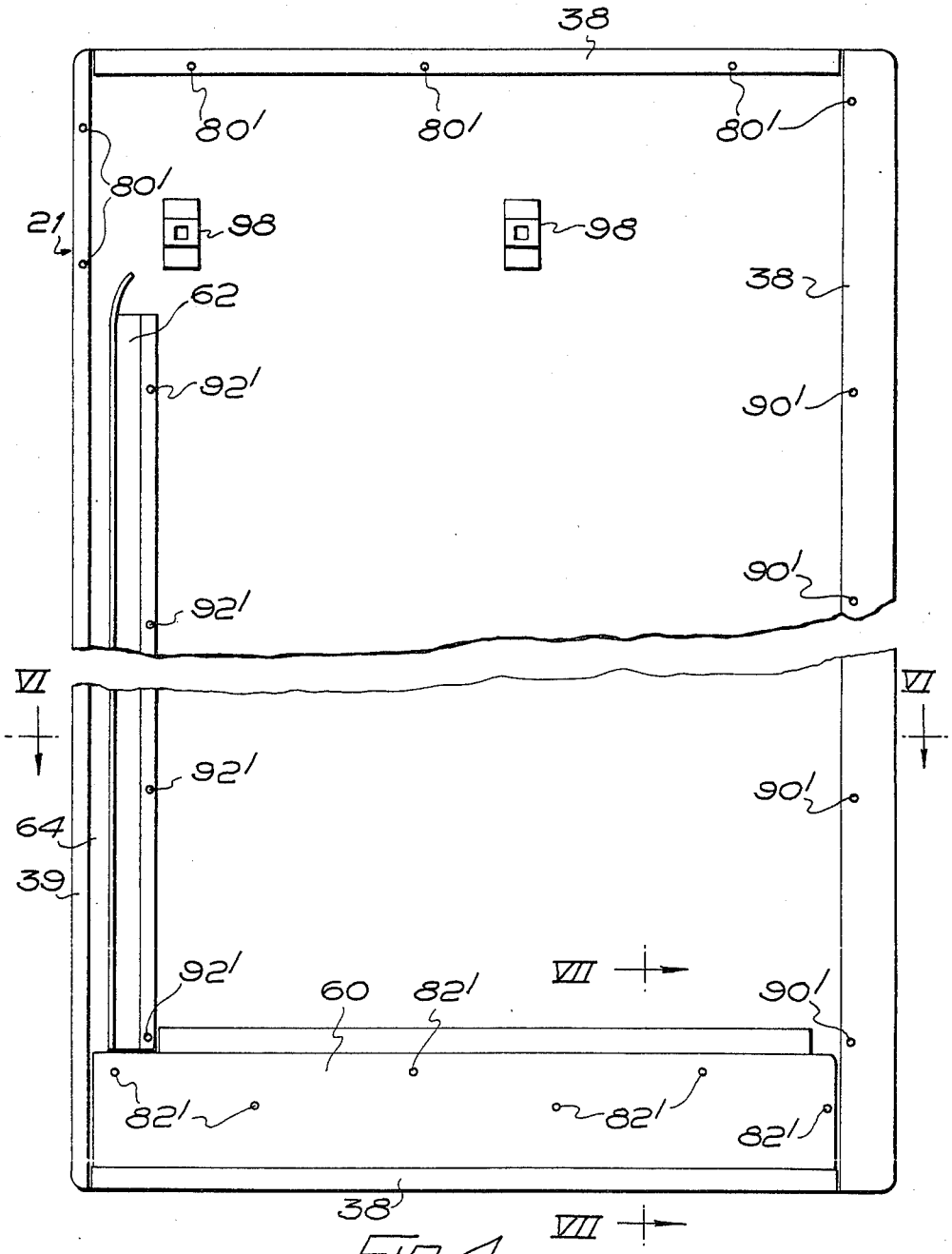
FIG. 4 shows the outer section of the left hand end from the inside after forming it to shape from the blank of FIG. 3, and welding on further parts.
Figure 5:
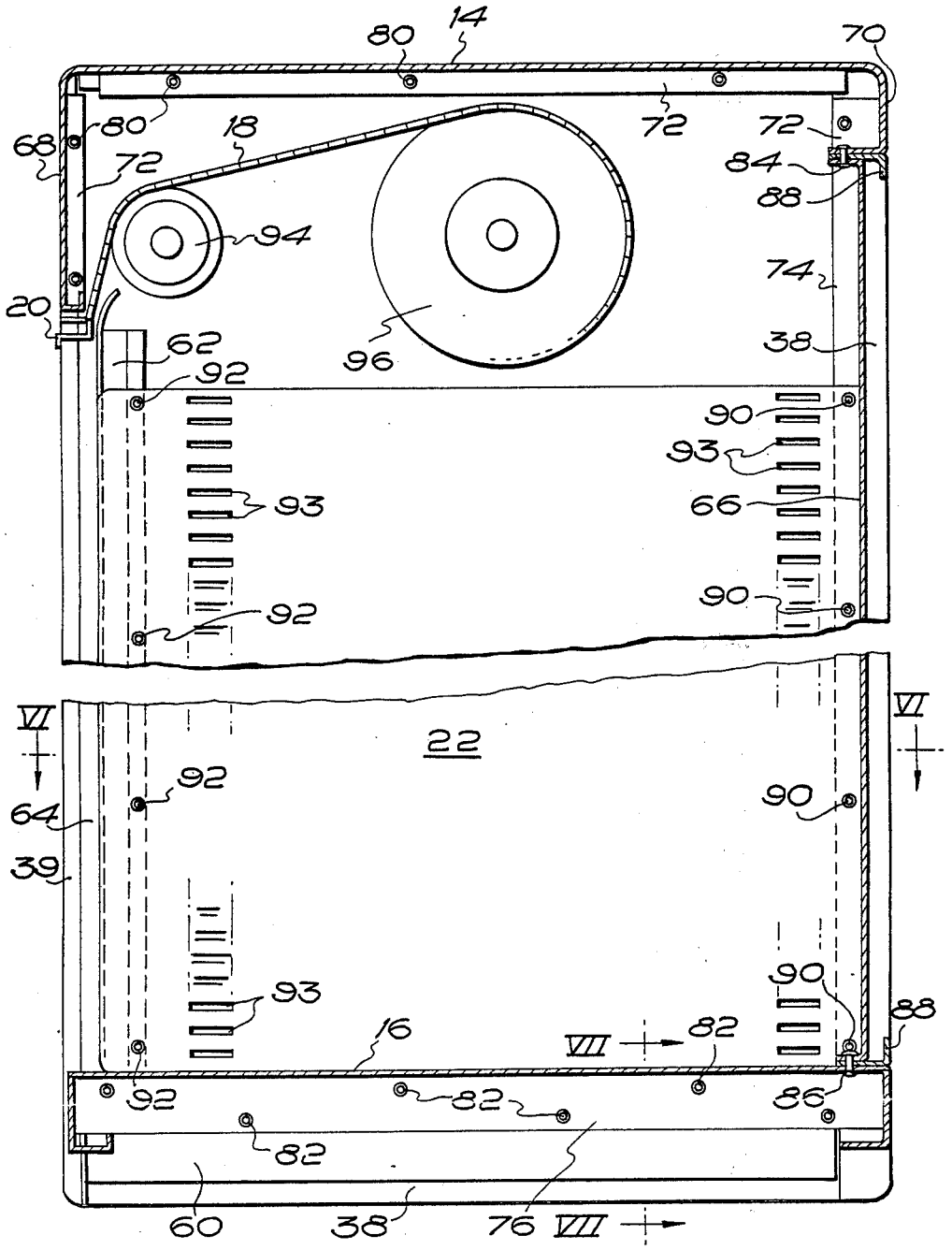
FIG. 5 is a vertical section through the cabinet on line V—V of FIG. 2, and provides a corresponding view to FIG. 4, after assembly.
Figure 7:
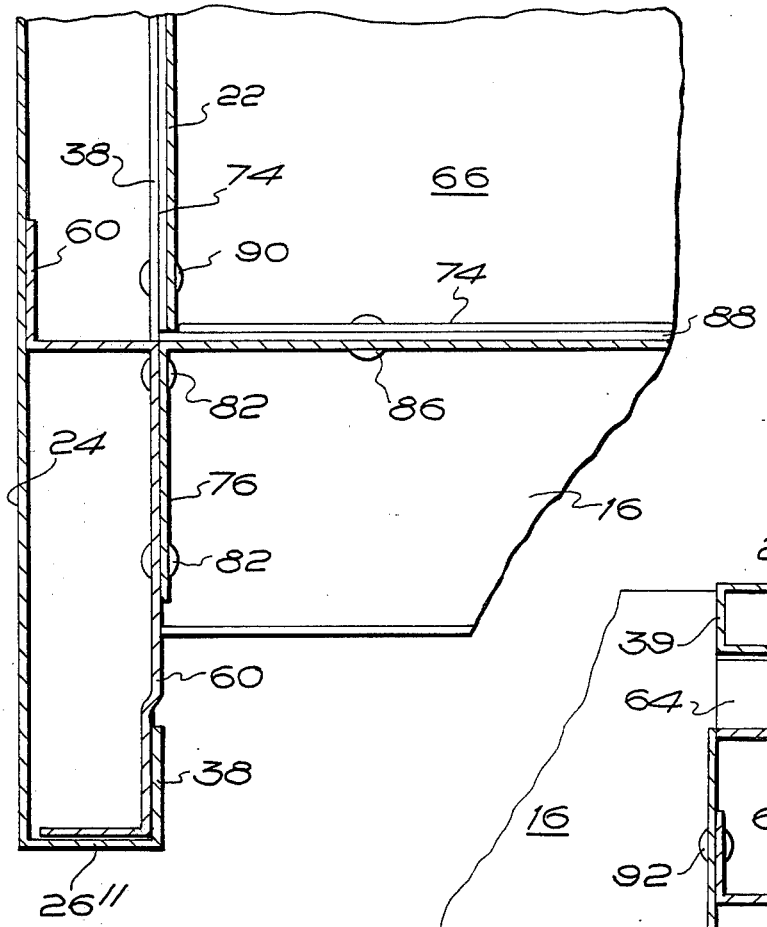
FIG. 7 is a section on the line VII—VII of FIGS. 4 and 5.
Figure 6:
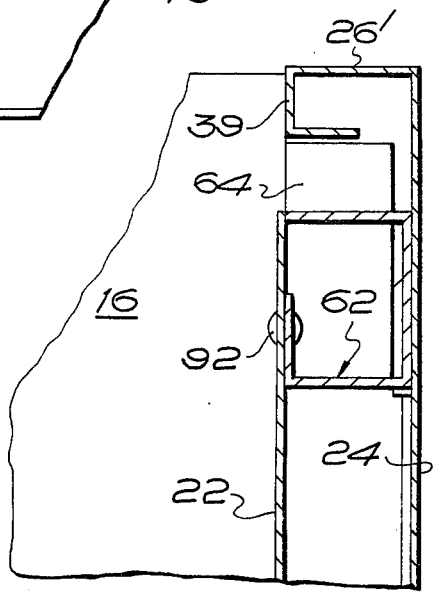
FIG. 6 is a section on the line VI—VI of FIGS. 4 and 5.
Figure 6:
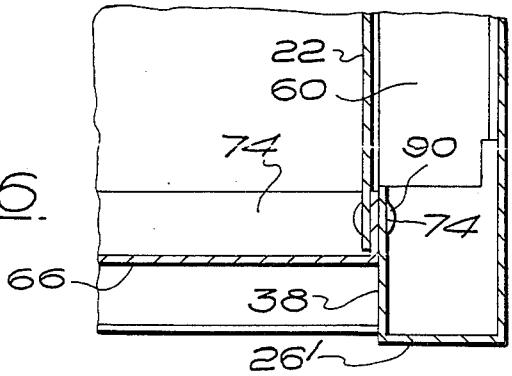

As can be seen from FIG. 1, the cabinet is designed so that its end members 12 appear to be separate slabs between which extend the top 14, base 16 and back of the cabinet. The front of the cabinet is closed by a roller shutter 18, also known as a tambour, with a handle 20 at its bottom end.

Each end member 12 consists of a press-formed outer section 21 and a planar inner panel 22. Each outer section has a plane face 24, which forms a side face of the cabinet, surrounded by edge faces 26. The face 24 is generally rectangular with all four corners radiussed. The edge faces extend along the whole periphery of the face 24 and curve smoothly around the radiussed corners so that the edge faces 26' at the front and back merge smoothly into the edge faces 26" at top and bottom.

The outer section 21 of each end member is formed from a sheet steel blank as shown in FIG. 3. The outline of this includes arcs 30 which will become the radiussed corners of face 24. On FIG. 3 the lines along which the blank is eventually bent are shown chain dotted, but until the blank is bent these lines are not visible in any way. They will be referred to for convenience of description.

The area which forms the plane face 24 is bounded by the arcs 30 and lines 32,34. There are extensions from this area contiguous with it along the whole of the lines 34 and almost all of the lines 32. The outline of the blank includes very short sections 32' of the lines 32, though. The edge faces 26 are formed by the areas 36 between the lines 32,34 and the respective parallel lines 42,44. Projections 46 continue beyond the junctions of the lines 34 and the arcs 30. These form the curving edge faces at the radiussed corners of the face 24.

A number of holes are made in outer areas 38,39 of the blank before it is formed to shape. These holes are used for rivetting at a later stage. The blank is formed to shape by conventional press forming. However, at least some of the shaping could be effected by roll-forming. When press forming is the only shaping operation, it accomplishes the following steps, not necessarily in the same order:

(i) the edge forming areas 36 are turned at right angles to the area forming the face 24 so that the lines 32,34 become the horizontal and vertical straight edges of the plane face 24;